United States Patent [19]

Thompson

[11] Patent Number: 4,470,213

[45] Date of Patent: Sep. 11, 1984

[54] LOAD BEARING SOLAR POWERED DISPLAYS

[76] Inventor: Marion E. Thompson, 2803 N. Prospect St., Colorado Springs, Colo. 80907

[21] Appl. No.: 457,939

[22] Filed: Jan. 14, 1983

[51] Int. Cl.[3] ..... G09F 11/02

[52] U.S. Cl. ..... 40/473; 40/503; 318/345 B

[58] Field of Search ..... 40/473, 465, 902, 455, 40/456, 457, 430, 505, 504, 503; 46/254, 232; 136/293; 323/231, 906, 901; 363/21, 49; 318/345.8, 341

[56] References Cited

U.S. PATENT DOCUMENTS

| | | | |
|---|---|---|---|
| 442,629 | 12/1890 | Lipscomb | 40/617 X |
| 2,580,671 | 1/1952 | Goyette | 40/617 |
| 2,866,670 | 12/1958 | Harris et al. . | |
| 3,031,784 | 5/1962 | Stein . | |
| 3,707,050 | 12/1972 | Schoenung | 40/617 X |
| 3,803,735 | 4/1974 | Stubbmann | 40/617 X |
| 3,888,233 | 6/1975 | Ware | 46/232 X |
| 4,063,307 | 12/1977 | Stephens | 363/21 |
| 4,084,219 | 4/1978 | Furukawa et al. | 363/21 |
| 4,108,405 | 8/1978 | Gibson | 40/902 X |
| 4,207,696 | 6/1980 | Hyman et al. | 40/473 |
| 4,227,327 | 10/1980 | Thompson | 40/473 |
| 4,274,218 | 6/1981 | Harvey | 40/505 |

OTHER PUBLICATIONS

Marcus, "Source Book of Electronic Circuits"; McGraw-Hill, copyright 1968 (pp. 519 and 529).

Furlow, "Circuit Design Idea Handbook", Cahners Publishing Company, copyright 1974 (pp. 49, 56, and 60).

Solart's Energy Sources Brochure, "Light Motionizers," ©1980.

*Primary Examiner*—Robert P. Swiatek

*Assistant Examiner*—Michael J. Foycik

*Attorney, Agent, or Firm*—Cushman, Darby & Cushman

[57] ABSTRACT

A power assembly for rotating a display is simple, inexpensive, has long life, and can rotate even heavy displays. A housing mounts a d.c. motor having an output shaft, and has a support structure. A ball bearing assembly, having a second shaft, is stationarily held by the support structure, and a flexible tubular connector interconnects the motor output shaft and the second shaft. The display is attached to the second shaft by a flexible band of elastomeric material. An electronic circuit provides power pulses from a substantially constant d.c. power source (such as a bank of solar cells) to operate the d.c. motor.

19 Claims, 7 Drawing Figures

LOAD BEARING SOLAR POWERED DISPLAYS

BACKGROUND AND SUMMARY OF THE INVENTION

For the merchandising of products, and for providing conversation pieces in homes and offices, it is desirable to utilize simple, versatile, attention-capturing devices. The devices disclosed in U.S. Pat. No. 4,227,327 and co-pending application Ser. Nos. 142,995 filed Apr. 23, 1980 and 303,501, now U.S. Pat. No. 4,379,324, Dec. 18, 1981, go a long way toward accomplishing such objectives. One limiting factor associated with such displays—which require an electrical motor—is how much weight the motor can support when a hanging display is utilized, and in circumstances irrespective of whether or not a hanging display is utilized the life of the motor and the power source is an important factor. The utilization of solar cells as the power source effectively provides a long life therefor, and the use of paladium leaf brushes in the motor, commutator segments that are open to prevent metal particle shorting, and brass bearings in the motor, can help extend motor life. However some problems of motor life, and the problem of the weight of displays (particularly hanging displays) rotated by the motor, remain.

According to the present invention a power assembly is provided for rotating a display, and particularly hanging displays, that substantially overcomes the weight-supporting and life problems of motors associated with prior art displays. According to one aspect of the present invention, the weight of the display is supported by a load bearing distinct from a small d.c. motor output shaft, with an interconnection, such as a tubular sleeve of elastomeric material, therebetween. According to another aspect of the present invention, problems of motor life can be remedied—and the advantages of a small power source and simplicity of construction utilized—by providing a flexible band connector, or the like, between the motor, or other output, shaft and the display, and by utilizing electronic circuitry means for providing timed electrical pulses to the motor from a power source (such as a bank of solar cells) of substantially constant power output.

It is the primary object of the present invention to provide a simple attention-getting and holding display including a power assembly capable of supporting displays of large weight, and providing essentially constant rotational speed of the display utilizing a relatively small power source, and with long motor life. This and other objects of the invention will become clear from an inspection of the detailed description of the invention and from the appended claims.

DETAILED DESCRIPTION OF THE DRAWINGS

Figure 1:
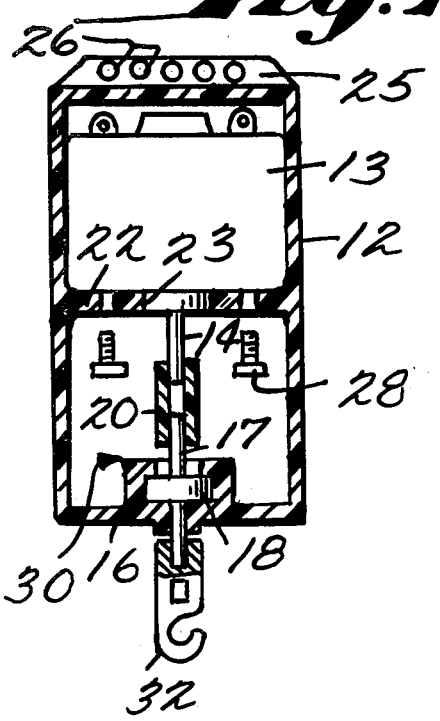
FIG. 1 is a side view, partly in cross-section and partly in elevation, of an exemplary power assembly according to the present invention.

An exemplary power assembly according to the present invention is shown generally by reference numeral 10 in FIG. 1. Major components of the assembly 10 include a housing 12, a d.c. motor 13 having an output shaft 14, a support structure 16, a second shaft 17, a bearing assembly 18, and a flexible tubular connector 20.

The housing 12 may be constructed of any suitable material, and it may be a sealed housing, a snap together housing, or the like. For instance the housing 12 may be formed of two pieces of injection molded plastic which fit together, and which include a common center wall 22 with central opening 23 for passage of shaft 14, each part of the housing 12 including a semi-circular opening 23 in wall 22 thereof to thereby allow easy removal and replacement of the small d.c. motor 13. Means may be provided for suspending the housing 12 so that the shaft 14 is substantially vertically downward, and in the embodiment illustrated in FIG. 1 such means takes the form of a central flange 25 having a plurality of openings 26 therein. The openings 26 each extend in a dimension generally perpendicular to the shaft 14, and are spaced from each other in a dimension both generally perpendicular to the shaft 14 and generally perpendicular to the dimension in which the openings 26 extend. By providing the openings 26 in this manner, the housing 12 may be mounted so that it is fully vertical, or at a variety of angles with respect to the vertical. The housing 12 may have any desired cross-sectional configuration (e.g. circular or rectangular).

The motor 13 comprises a conventional small d.c. motor. Where long life is especially desirable, the motor preferably has paladium leaf brushes, and the motor bearings are brass. Also the commutator segments are open to prevent metal particle shorting.

The assembly 10 further comprises means for mounting the d.c. motor 13 within the housing 12. In the embodiment illustrated in FIG. 1 such means take the form of the center wall 22, and a plurality of fasteners 28 (e.g. screws) which attach the motor 13 to the center wall 22.

In the embodiment illustrated in FIG. 1 the support structure 16 is an integral molded part of the rest of the housing 12, and contains mean 30 defining a cavity for tightly holding the outer race of the ball bearing assembly 18 so that it is stationary with respect to the housing 12.

The ball bearing assembly 18 comprises means for mounting the second shaft 17 to the support structure 16 for rotation of the shaft 17 with respect to the structure 16 so that the shaft 17 and structure 16 carry the weight of a display operatively connected thereto—and thus the motor output shaft 14 does not carry the display weight. While a ball bearing assembly is preferred, other means for performing this function also could be utilized. The ball bearing assembly 18 preferably comprises a conventional ball bearing assembly, tubing, the internal diameter of the tubing 20 is slightly less than the outside diameters of shafts 14, 17, so that it fits snuggly thereon and provides the proper interconnection. The provision of the coupler 20 facilitates ease of manufacture of the assembly 10 since it is easy to interconnect the shafts 14, 17 irrespective of tolerances, and provides an appropriate and desirable interconnection between the shafts 14, 17.

Figure 3:
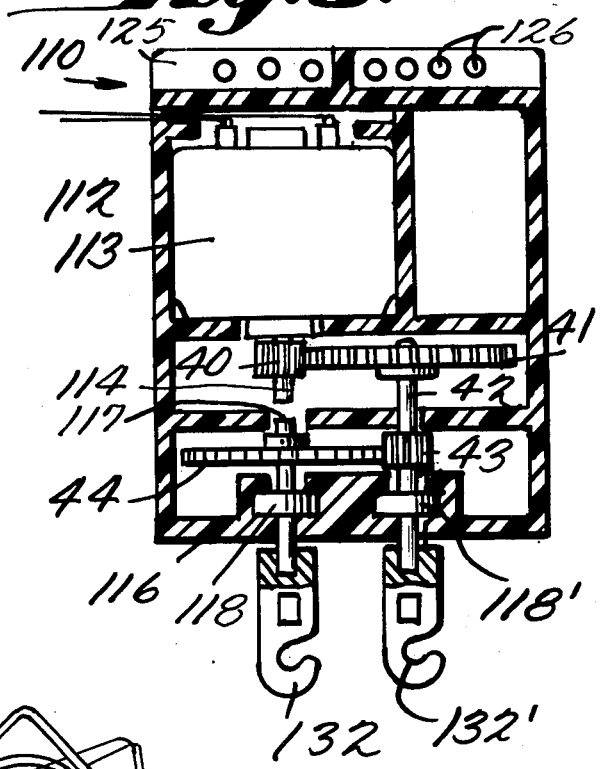
FIG. 3 is a side view, partly in cross-section and partly in elevation, of another exemplary embodiment of a power assembly according to the present invention.

In the FIG. 3 embodiment, structures corresponding to those in the FIG. 1 embodiment are indicated by the same reference numeral only preceded by the numeral "1". This embodiment is substantially identical to the FIG. 1 embodiment except that the means for operatively connecting the second shaft 117 to the motor output shaft 114 comprises reduction gearing means including a small gear 40 affixed to shaft 114, a large gear 41 attached to third shaft 42 which is mounted for rotation with respect to support structure 116 by ball bearing assembly 118', a small gear 43 also connected to third shaft 42, and a large gear 44 connected to second shaft 117 such as shown in U.S. Pat. No. 2,866,670, having an outer stationary race, an inner race to which the second shaft 17 is rigidly connected, and a plurality of ball bearings between the races.

Means are associated with a portion of the shaft 17 for facilitating attachment of a display to the shaft 17. For instance such means may take the form of a plastic hook 32 having an interference fit with the end of shaft 17 remote from shaft 14.

The flexible tubular connector 20 comprises means for operatively connecting the shaft 17 to the shaft 14 so that rotation of shaft 14 by the motor 13 effects rotation of the shaft 17 with respect to the support structure 16. While a flexible tubular connector is preferred, other connecting means could also be utilized. In the embodiment illustrated in FIG. 1, the connector 20 provides one revolution of the shaft 17 for one revolution of the shaft 14, and provides the only interconnection between those shafts 14, 17. In a preferred embodiment the tubular connector 20 comprises a flexible tube of elastomeric material, such as a piece of surgical tubing. The hook 132' also may be provided as a second output from the assembly 110, the hook 132' being press fit to the third shaft 42. The hooks 132', 132 will thus rotate at two different speeds, both lower than the speed of rotation of the motor output shaft 114. The assembly 110 would normally be utilized only in situations where extremely heavy displays were to be supported (e.g. potted plants), and/or where cost was not a substantial consideration.

Figure 2:
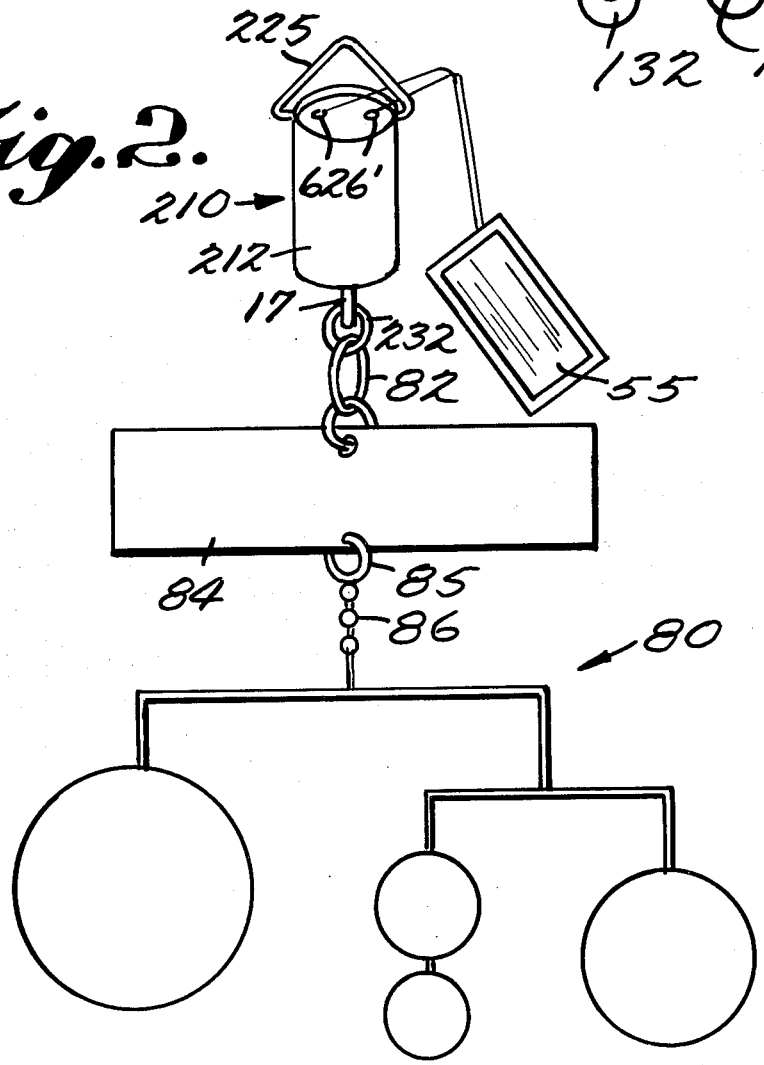
FIG. 2 is a side perspective view of another embodiment of an exemplary power assembly according to the present invention in combination with a hanging display and an interconnection between the display and the assembly.
Figure 4:
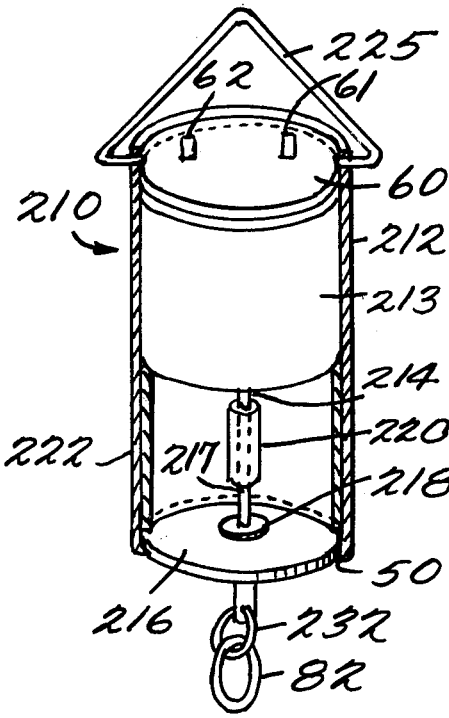
FIG. 4 is a detailed perspective view, partly in cross-section, of the power assembly of FIG. 2.

In the embodiment of the power assembly (210) illustrated in FIGS. 2 and 4, components corresponding to those of the FIG. 1 embodiment are indicated by like reference numerals only preceded by a "2". In this embodiment the housing 212 is of cardboard, or like inexpensive cellulosic fibrous material. The support structure 216 preferably comprises a plate of rigid material, such as a brass or PCB plate, stationarily held with respect to the housing 12 by the rolled bottom edge 50 of the housing 212. The outer race of the bearing assembly 218 is press fit into a central opening in the plate 216. The means for mounting the d.c. motor 213 within the housing 212 comprises a tube 222 of cardboard or like inexpensive cellulosic fibrous material which surrounds the shafts 214, 217, and extends between the bottom of the motor 213 and the plate 216. Hanging of the assembly 210 is facilitated by the metal clip hanger 225.

In the FIG. 4 embodiment, electronic circuitry is provided for interconnecting the motor 213 to a substantially constant output low voltage power source, to provide timed electrical pulses to the motor 213 to provide spaced brief periods of operation thereof. The power source may comprise a battery, but preferably comprises one or more solar cells, illustrated by reference numeral 55 in FIGS. 2 and 5 through 7. The solar cell 55 may be integral with the housing 212, or may be detached therefrom (as illustrated in FIG. 2), and may be provided with any conventional mounting means for mounting it to a light bulb, or the like, such as shown in said co-pending application Ser. Nos. 303,501 and 142,995, and as shown in U.S. Pat. No. 4,227,327.

The electronic circuitry associated with the FIG. 4 embodiment may be mounted on a printed circuit board 60 in the shape of a disk which is held within the housing 212 by an interference fit or the like. Connectors 61, 62 of the printed circuit board 60 are attached to the solar cell 55 (see FIG. 2), and electrical interconnections (not shown) are provided between the printed circuit board 60 and the motor 213.

Figure 5:
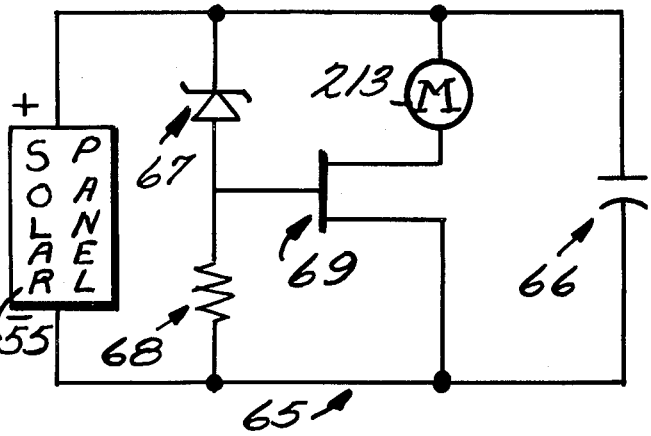
FIGS. 5, 6 and 7 are schematic circuit diagrams of exemplary electronic circuitry utilizable with the assembly of FIG. 4 to pulse the motor thereof, the motor and a power source being illustrated in the schematic circuit diagrams.

One form that the electronic circuitry may take is illustrated generally by reference numeral 65 in FIG. 5. In this embodiment the electronic circuitry consists essentially of a storage/pulse capacitor 66 electrically interconnected to a Zener diode 67, resistor 68, and FET 69. The solar panel 55 provides four volts + potential, and five m.a. + current. As long as light is striking the solar panel 55 the Zener diode 67 will periodically reach its voltage knee, and fire the FET 69, which will cause the motor 213 to rotate output shaft 214 rapidly for a short period of time, then go off, the cycle repeating itself indefinitely as long as sufficient incident light energy is striking the solar panel 55. The frequency of the pulsing is determined by the incident light energy available, as well as by the selection of the components 66–69.

Figure 7:
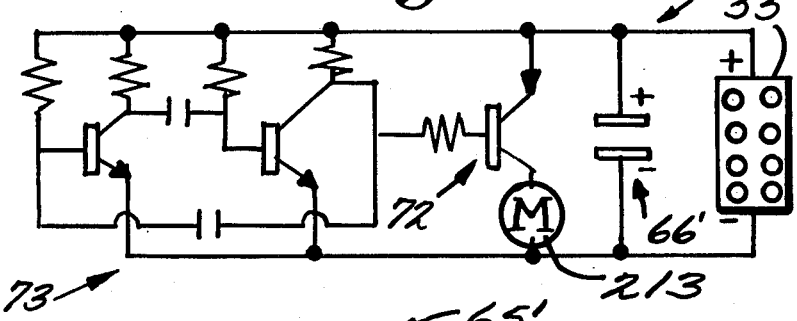
Figure 6:
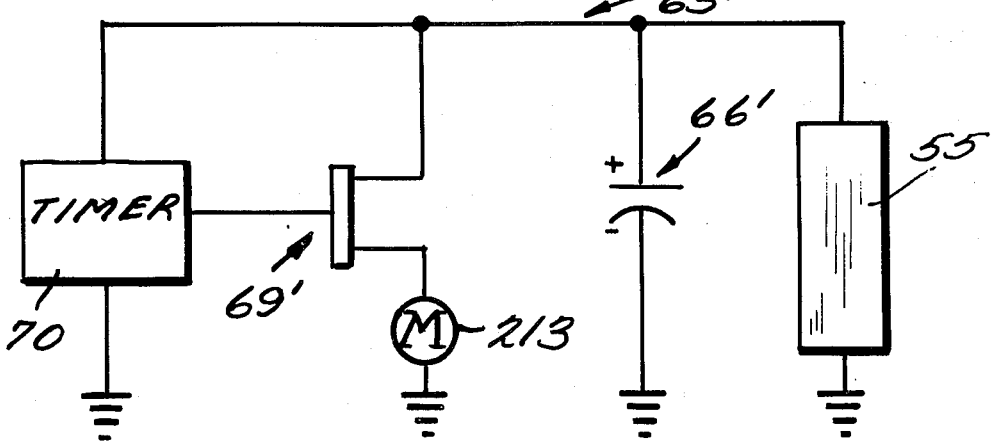

Alternative configurations that the pulsing circuitry could take are shown generally by reference numerals 65' and 65'' in FIGS. 6 and 7 respectively. In the FIG. 6 embodiment, the circuitry 65' consists essentially of the capacitor 66', the FET 69' and the timer 70. The timer 70 may be an inexpensive timer, such as a number 555 FET timer, having essentially no current drain, and having about a 2 volt minimum.

In the FIG. 7 embodiment, the circuitry 65'' includes a capacitor 66'', transistor 72, and timing circuitry 73. The solar cell 55 provides about 5–10 m.a. current, and about 6 volts potential. Capacitor 66'' charges to approximately 6 volts at a slow rate, depending upon the size of the cell or cell bank 55 and the intensity of light thereon. The transistor 72 fires and discharges capacitor 66'' through the motor 213. This cycle repeats itself as long as light is supplied to the cell 55.

The power assembly 210 is utilized in combination with a display 80 (see FIG. 2) or the like. Means are provided for operatively attaching the display 80 to the ring 232 (i.e. ultimately to the motor output shaft 214) for storing energy from a relatively high rotational speed of the output shaft and disbursing the energy to the display 80 to effect a relatively low, constant, rotational speed. Such means preferably take the form of a flexible band of elastomeric material 82 (see FIGS. 2 and 4). During each period of time that the motor 213 is operating, being supplied with an electrical energy pulse by the circuitry 65, 65', 65'', the shaft 217 turns relatively rapidly, and causes the rubber band 82 or the like to become twisted (i.e. "wound up"). During the time between supply of the power pulses that the motor 213 is not operating, the energy stored in the rubber band 82 is disbursed to the display 80, causing a constant slow rotation thereof even though the motor 213 is being pulsed.

In order to control rotational speed of the display 80 it is desirable to utilize a substantially planar surface member which provides substantial air resistance to the rotation of the display 80. This concept is disclosed in U.S. Pat. No. 4,227,327 and copending application Ser. No. 142,995. For instance the area of the sign member 84 (see FIG. 2) is chosen so as to control the rotational speed of the display 80, and a ring 85 and swivel connector 86 may connect the display 80 to the sign member 84.

Exemplary apparatus according to the invention having been described, an exemplary manner of operation thereof will now be set forth with respect to FIGS. 2, 4, and 5.

The hanging wire 225 is hung from a ceiling connected hook or the like, and the solar cell bank 55 is placed adjacent a light source of sufficient intensity for the cell bank 55 to generate electricity for operation of the circuit 65 and motor 213. The ring 232 is connected by rubber band 82 to sign member 84, which in turn is connected by ring 85 and swivel connector 86 to a display 80.

Light striking the solar bank 55 generates electricity, which is supplied to the circuitry 65. The Zener diode 67 periodically reaches its voltage knee, and fires the FET 69, so that the capacitor 66 discharges through the motor 213, effecting temporary operation thereof. When the motor 213 is supplied with electrical energy, it causes a relatively high rotational speed of the output shaft 214, which is exactly transferred through surgical tubing 220 to second shaft 217, which rotates with respect to support structure 216 in ball bearing assembly 218. This causes the rubber band 82 to be wound up, while the display 80 is being rotated at a lower rotational speed than the second shaft 217. The energy stored by the winding up of the rubber band 82 is disbursed to the assembly 80 between the supply of periodic pulses of electrical energy to the motor 213 by the circuitry 65. Thus the display 80 rotates at a substantially constant relatively slow speed, sufficient for ready recognition of any visual indicia thereon, the rotational speed being affected by the chosen area of the sign member 84.

It will thus be seen that according to the present invention a simple attention-getting and holding display including a power assembly capable of supporting displays of large weight, and providing essentially constant rotational speed of the display utilizing a relatively small power source, and with long motor life, has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A power assembly for rotating a hanging display, comprising:

a housing;

a d.c. motor having an output shaft extending downwardly in use;

means for mounting said d.c. motor within said housing;

a support structure operatively stationary with respect to said housing;

a second shaft, distinct from said d.c. motor output shaft;

means for mounting said second shaft to said support structure for rotation of said second shaft with respect to said support structure so that said second shaft and support structure carry the entire weight of a display operatively connected thereto independent of said d.c. motor output shaft;

means associated with a portion of said second shaft for facilitating attachment of a display to said second shaft; and means for operatively connecting said second shaft to said d.c. motor output shaft so that rotation of said d.c. motor output shaft effects rotation of said second shaft with respect to said support structure.

2. An assembly as recited in claim 1 wherein said means for mounting said second shaft to said support structure comprises a ball bearing assembly, a portion of said support structure holding said ball bearing assembly thereto.

3. An assembly as recited in claim 2 wherein said ball bearing assembly comprises an outer race, an inner race, and a plurality of balls disposed between said inner and outer races; said second shaft affixedly attached to said inner race; and said portion of said support structure for holding said ball bearing assembly holding said outer race stationary with respect to said support structure.

4. An assembly as recited in claim 3 wherein said means for operatively connecting said second shaft to said d.c. motor output shaft comprises means for interconnecting said shafts so that one revolution of said d.c. motor output shaft is translated to one revolution of said second shaft.

5. An assembly as recited in claim 4 wherein said means for operatively connecting said second shaft to said d.c. motor output shaft consists of a flexible tubular coupling.

6. An assembly as recited in claim 5 wherein said flexible tubular coupling comprises elastomeric material.

7. An assembly as recited in claim 1 wherein said means for operatively connecting said second shaft to said d.c. motor output shaft consists of a flexible tubular coupling.

8. An assembly as recited in claim 7 wherein said flexible tubular coupling comprises elastomeric material.

9. An assembly as recited in claim 1 wherein said support structure comprises a bottom portion of said housing, and wherein said means for mounting said d.c. motor within said housing comprises a tube of inexpensive cellulosic fibrous material extending between said support structure and said motor and surrounding said motor output shaft.

10. An assembly as recited in claim 9 wherein said housing is of inexpensive fibrous cellulosic material, and wherein said support structure comprises an operatively rigid plate attached to said housing and forming the bottom thereof.

11. An assembly as recited in claim 1 further comprising means for suspending said housing so that said output shaft from said d.c. motor extends generally downwardly, said suspending means operatively attached to said housing.

12. An assembly as recited in claim 11 wherein said means for suspending said housing comprises a flange and means defining a plurality of openings in said flange, said flange formed on said housing at an end thereof opposite said support structure, said openings each extending in a dimension generally perpendicular to said d.c. motor output shaft, and said openings spaced apart from each other in another dimension both perpendicular to said d.c. motor output shaft and to the dimension in which said openings extend.

13. An assembly as recited in claim 1 wherein said means for operatively connecting said second shaft to said d.c. motor output shaft comprise reduction gearing means, said reduction gearing means mounted within said housing.

14. An assembly as recited in claim 1 in combination with a display, and a flexible band of elastomeric material interconnecting said display and said means associated with a portion of said second shaft for facilitating attachment of a display to said second shaft.

15. An assembly as recited in claim 14 further comprising electronic circuit means for supplying a timed pulse of electrical energy to said d.c. motor from a substantially constant source of d.c. power.

16. An assembly as recited in claim 15 wherein said electronic circuitry means is mounted within said housing at a portion thereof remote from said d.c. motor output shaft.

17. An assembly as recited in claim 16 wherein said electronic circuitry means consists essentially of a FET, a resistor, a capacitor, and a Zener diode.

18. An assembly as recited in claim 15 further in combination with at least one solar cell providing said d.c. power source.

19. A power assembly for rotating a hanging display, comprising:

a housing;

a d.c. motor having an output shaft;

means for mounting said d.c. motor within said housing;

a support structure operatively stationary with respect to said housing;

a second shaft, distinct from said d.c. motor output shaft;

means for mounting said second shaft to said support structure for rotation of said second shaft with respect to said support structure so that said second shaft and support structure carry the weight of a display operatively connected thereto;

means associated with a portion of said second shaft for facilitating attachment of a display to said second shaft; and means for operatively connecting said second shaft to said d.c. motor output shaft so that rotation of said d.c. motor output shaft effects rotation of said second shaft with respect to said support structure, said connecting means comprising a flexible tubular coupling of elastomeric material having a first end thereof operatively attached to said d.c. motor output shaft, and having a second end thereof operatively attached to said second shaft.

* * * * *